US006932251B2

(12) United States Patent
Kolton et al.

(10) Patent No.: US 6,932,251 B2
(45) Date of Patent: Aug. 23, 2005

(54) HANGER AND SIZE MARKER AND ASSEMBLY THEREOF

(75) Inventors: Chester Kolton, Westfield, NJ (US); Michael Norman, East Brunswick, NJ (US); Robert Whittemore, Middletown, NY (US)

(73) Assignee: B&G Plastics, Inc., Newark, NJ (US)

( * ) Notice: Subject to any disclaimer, the term of this patent is extended or adjusted under 35 U.S.C. 154(b) by 76 days.

(21) Appl. No.: 10/413,914

(22) Filed: Apr. 15, 2003

(65) Prior Publication Data

US 2004/0206787 A1 Oct. 21, 2004

(51) Int. Cl.[7] ..... A41D 27/22
(52) U.S. Cl. ..... 223/85; 40/322
(58) Field of Search ..... 223/85, 92, 95; 40/322, 666, 611.01

(56) References Cited

U.S. PATENT DOCUMENTS

| | | | | |
|---|---|---|---|---|
| 3,949,914 A | | 4/1976 | Ostroll | |
| D244,197 S | | 5/1977 | Ostroll | |
| 4,115,940 A | | 9/1978 | Phillips | |
| 4,997,114 A | | 3/1991 | Petrou | |
| 5,069,373 A | | 12/1991 | Kolton et al. | |
| 5,096,101 A | | 3/1992 | Norman et al. | |
| 5,305,933 A | | 4/1994 | Zuckerman | |
| 5,441,182 A | | 8/1995 | Sullivan | |
| 5,449,099 A | | 9/1995 | Blanchard | |
| 5,611,469 A | | 3/1997 | Eiley et al. | |
| 5,687,887 A | | 11/1997 | Bond et al. | |
| 5,913,462 A | * | 6/1999 | Petrou | 223/85 |
| 5,950,883 A | * | 9/1999 | Bond et al. | 223/85 |

* cited by examiner

*Primary Examiner*—John J. Calvert
*Assistant Examiner*—James G Smith
(74) *Attorney, Agent, or Firm*—Hoffman & Baron, LLP

(57) ABSTRACT

A hanger has a support rod engaging portion, a garment supporting portion extending downwardly of the support rod engaging portion and a size marker receiving portion opening into the periphery of the hanger, the hanger defining in the size marker receiving portion at least one deflectable size marker retaining member. A size marker for assembly with a hanger includes a rigid body defining a ceiling and front and rear walls extending downwardly of the ceiling to a floor, at least one passage opening into the floor and extending to the ceiling, the body defining a recess extending between the front and rear walls, the recess communicating with the passage at an upper portion thereof.

5 Claims, 4 Drawing Sheets

HANGER AND SIZE MARKER AND ASSEMBLY THEREOF

FIELD OF THE INVENTION

The present invention relates generally to hangers and pertains more particularly to hangers and size markers attached thereto.

BACKGROUND OF THE INVENTION

One known hanger with size marker attached thereto is shown in U.S. Pat. No. 5,687,887 ("the '887 patent").

In the '887 patent, size marker mounting structure 15 of hanger 10 extends angularly between hook 12 and hanger body 11, forming a juncture therebetween, and includes parallel walls 29 and third wall 29' and rib 16 extending between parallel walls 29. A gap (not numbered) exists as between rib 16 and third wall 29'. The patent defines the gap as a hole or opening.

Marker 20 is mounted on or over rib 16 in self-locking relation and includes a pair of spaced apart parallel walls 21 which receive the rib therebetween. Each wall 21 includes three inwardly directed flanges 22, 23 and 24.

In order to mount the marker 20 on the rib 16, the lowermost flanges 22 of the marker 20 are disposed on the rounded top 17 of the rib 16. A force is then impressed on the marker 20 so that the inclined surfaces of the lowermost flanges 22] slide on the top 17 of the rib 16 thereby causing the walls 21 of the marker 20 to splay outwardly. Continued pressing of the marker 20 onto the rib 16 allows the lowermost flanges to pass over the top 17 followed by passage of the internal flanges 23, 24 over the top 17. This motion continues until the upper flanges 24 snap into the longitudinal grooves 19 of the rib 16. At the same time, the walls 21 of the marker 20 move towards each other so that the lowermost flanges 22 slide under the rib 16, that is, into the gap. At this time, the marker 20 becomes locked to the rib 16.

Another known hanger with size marker attached thereto is shown in U.S. Pat. No. 5,096,101 ("the 101 patent").

In the "101 patent, hanger 10 includes a tab mounting member (tab holder) 30 which extends intermediate shoulder 13 of hanger body 12 and angled base section 20 of hook member 14. Tab holder 30 includes an upper enlarged region 40 formed as an arrowhead having sloping sides 41 and 42 and ledges 43*a* and 43*b*. A lower enlarged region 44, also of arrowhead shape, is formed below upper region 40 and has sloping sidewalls 45 and 46. Base 47 is formed below region 44 and has ledges 47*a* and 47*b*.

Information tab 50 is generally U-shaped in cross-section and includes opposing legs 52 and 54 extending from top wall 56. Curved ends 52*a* and 54*a* of legs 52 and 54 define a gap 58 (FIG. Tab 50 further includes interior projections in the form of resilient fingers 60 and 62.

In assembling tab 50 with tab holder 30, gap 58 is arranged adjacent region 40 of tab holder 30 and is forced thereon, providing the assembly of FIG. 3. Due to the inward curved construction of the ends of the legs 52 and 54 which bear against wall 48 and rib 32, and the resilient fingers 60 and 62 locking under base 43, a double secure locking system is provided.

The '887 and the '101 patents require flexible structure in their size markers for self-locking the size markers to the hangers.

Other hanger and size marker assemblies are shown in U.S. Pat. Nos. 5,611,469, 5,441,182, 5,449,099, 5,305,933, 4,997,114, 4,115,940, 3,949,914 and U.S. Pat. No. Des. 244,914. All such assemblies have in common with the '887 and '101, the requirement for flexible structure in their size markers.

SUMMARY OF THE INVENTION

The present object has as its primary object an improved hanger, size marker and hanger and size marker assembly.

In attaining this and other objects, the invention provides, in one aspect, a hanger having a support rod engaging portion, a garment supporting portion extending downwardly of the support rod engaging portion and a size marker receiving portion opening into the periphery of the hanger, the hanger defining in the size marker receiving portion at least one deflectable size marker retaining member.

In another aspect, the invention provides a size marker for assembly with a hanger comprising a rigid body defining a ceiling and front and rear walls extending downwardly of the ceiling to a floor, at least one passage opening into the floor and extending to the ceiling, the body defining a recess extending between the front and rear walls, the recess communicating with the passage at an upper portion thereof.

In a further aspect, the invention provides, in combination, a hanger having a support rod engaging portion, a garment supporting portion extending downwardly of the support rod engaging portion and a size marker receiving portion opening into the periphery of the hanger, the hanger defining in the size marker receiving portion at least one deflectable size marker retaining member and a size marker disposed in the hanger size marker receiving portion and secured to the hanger by the deflectable size marker retaining member.

The invention will be further understood from consideration of the following description of preferred embodiments thereof and from the drawings where like reference numerals identify like parts throughout.

DETAILED DESCRIPTION OF PREFERRED EMBODIMENTS AND PRACTICES

Figure 1A:
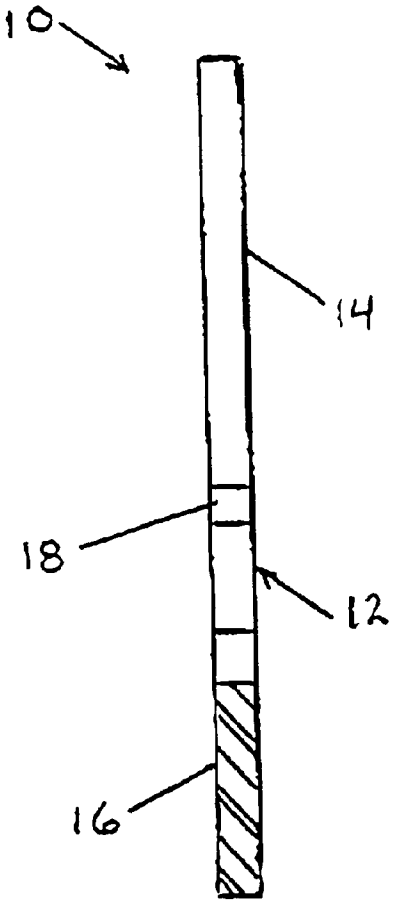
FIG. 1A is right side elevation of FIG. 1.
Figure 1:
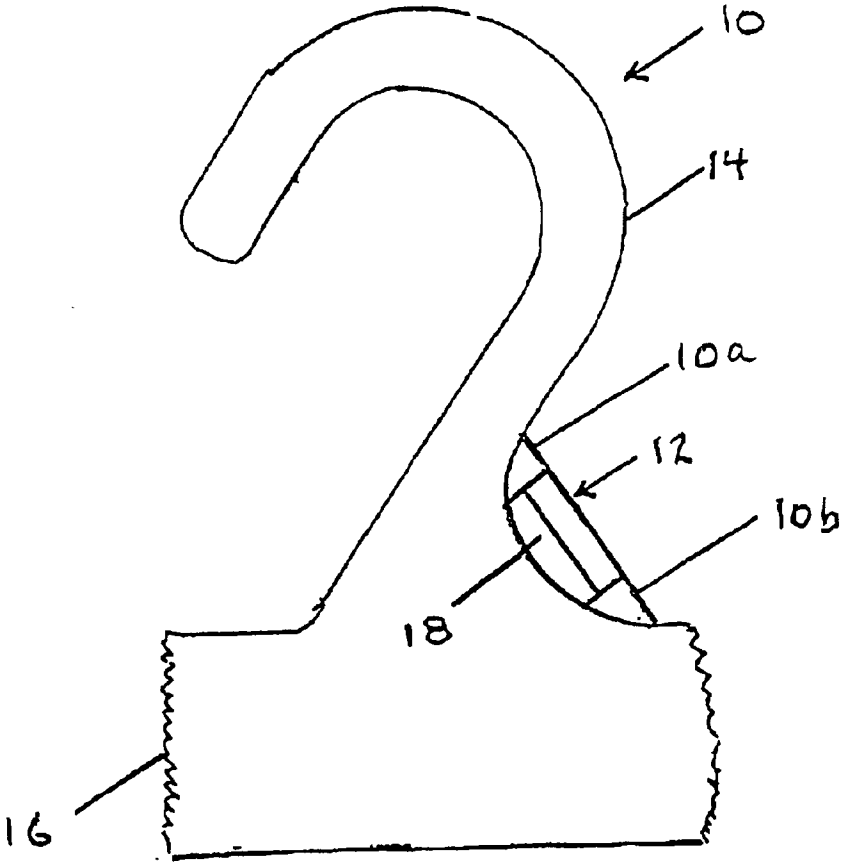
FIG. 1 is a front elevation of a hanger and size marker assembly in accordance with the invention.

Referring to FIGS. 1 and 1A, a first embodiment of a hanger and size marker assembly in accordance with the invention includes hanger 10 and size marker 12. Hanger 10 comprises support rod engaging portion 14, garment supporting portion 16 and size marker receiving portion 18. Size marker 12 is retained in size marker receiving portion 18 once size marker 12 is applied to hanger 10.

Garment supporting portion 16 is shown generically, i.e., without specificity as to its garment supporting appurtenances, which are not of consequence to the subject invention, and which may take any of well-known structures. For example, such appurtenances may be as shown in commonly-owned U.S. Pat. No. 5,069,373, which is incorporated herein by this reference thereto.

Figure 2:
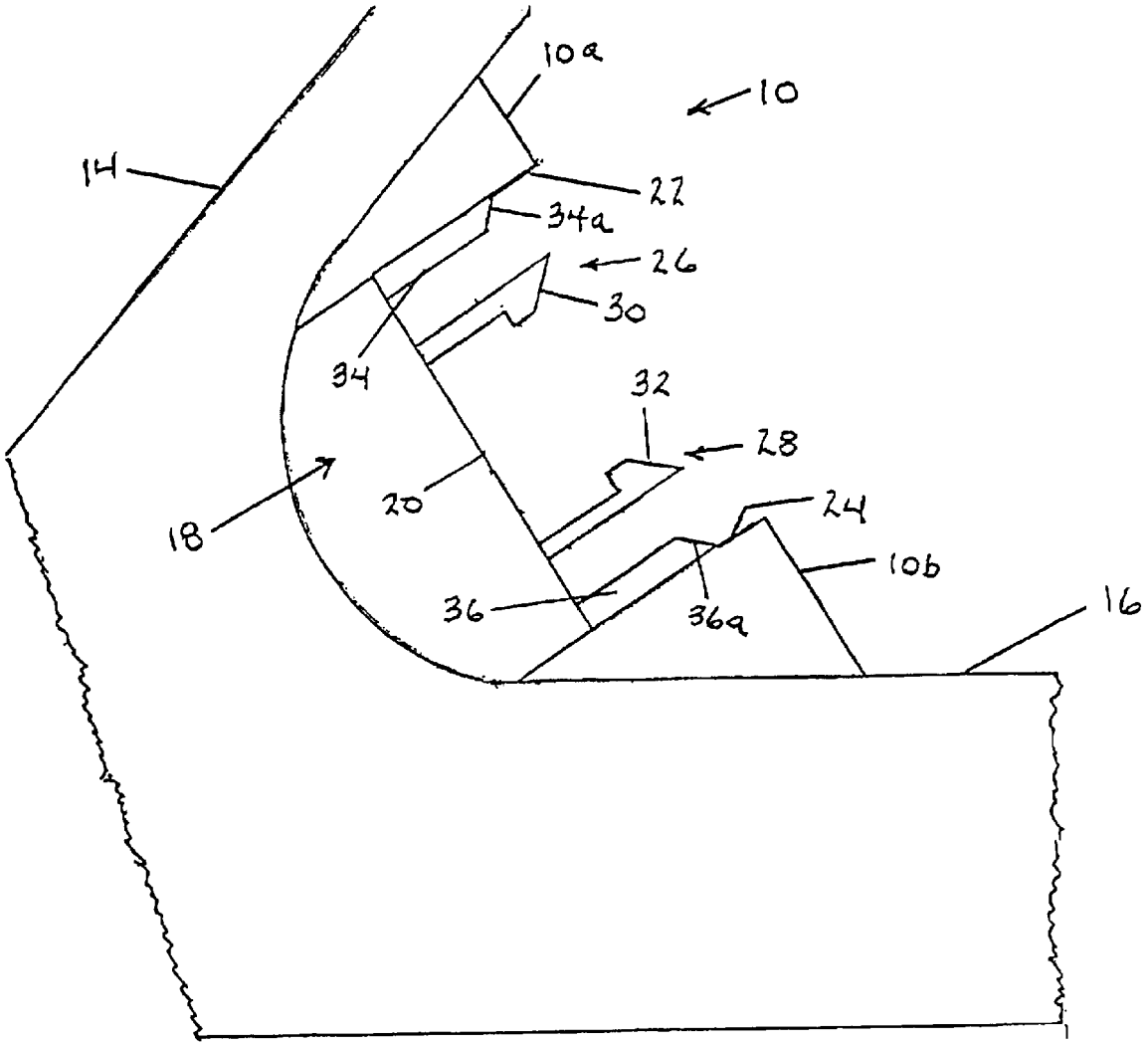
FIG. 2 is a partial view of the hanger of FIG. 1, showing the structure of the size marker receiving portion thereof.

Referring to FIG. 2, size marker receiving portion 18 includes outwardly open recess, bounded by floor 20 and sidewalls 22 and 24, which extend upwardly or outwardly of floor 20.

Size marker retaining members 26 and 28 extend upwardly or outwardly of floor to free ends which have retaining structures 30 and 32 formed thereon preferably in the form of hooks. Guide ribs 34 and 36 are formed on sidewalls 22 and 24 with guiding bevels 34*a* and 36*a*.

Sidewalls 22 and 24 each have a dimension outwardly of floor 20 which exceeds a dimension of each of size marker retaining members 26 and 28 outwardly of floor 20 for purposes discussed below.

Figure 3:
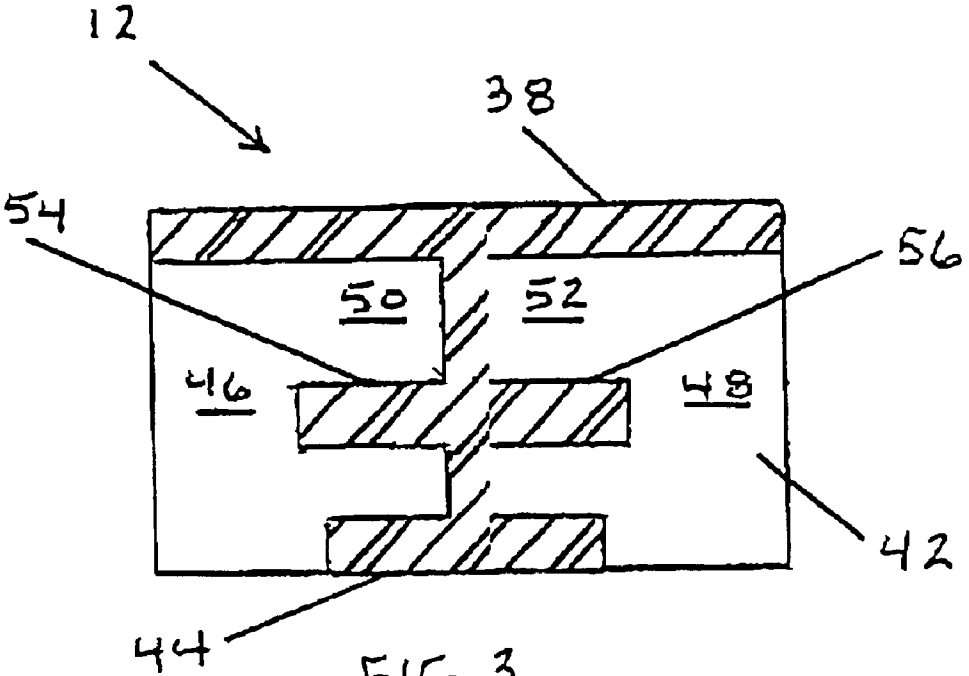
FIG. 3 is a central sectional view of a size marker in accordance with the invention.
Figure 4:
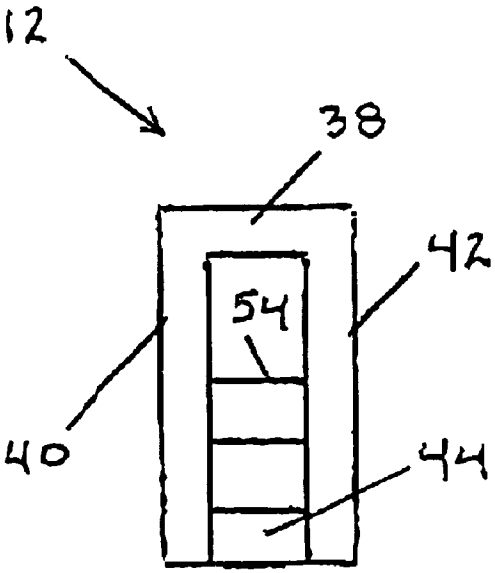
FIG. 4 is a left side elevation of the size marker of FIG. 3.

Turning to FIGS. 3 and 4, size marker 12 is a rigid, i.e., inflexible body, which includes ceiling 38, from which depend front wall 40 and rear wall 42, and central floor portion 44. Sidewardly open passages 46 and 48 extend from floor portion 44. Recesses 50 and 52 communicate with passages 46 and 48 above hook catching ledges 54 and 56.

Figure 5:
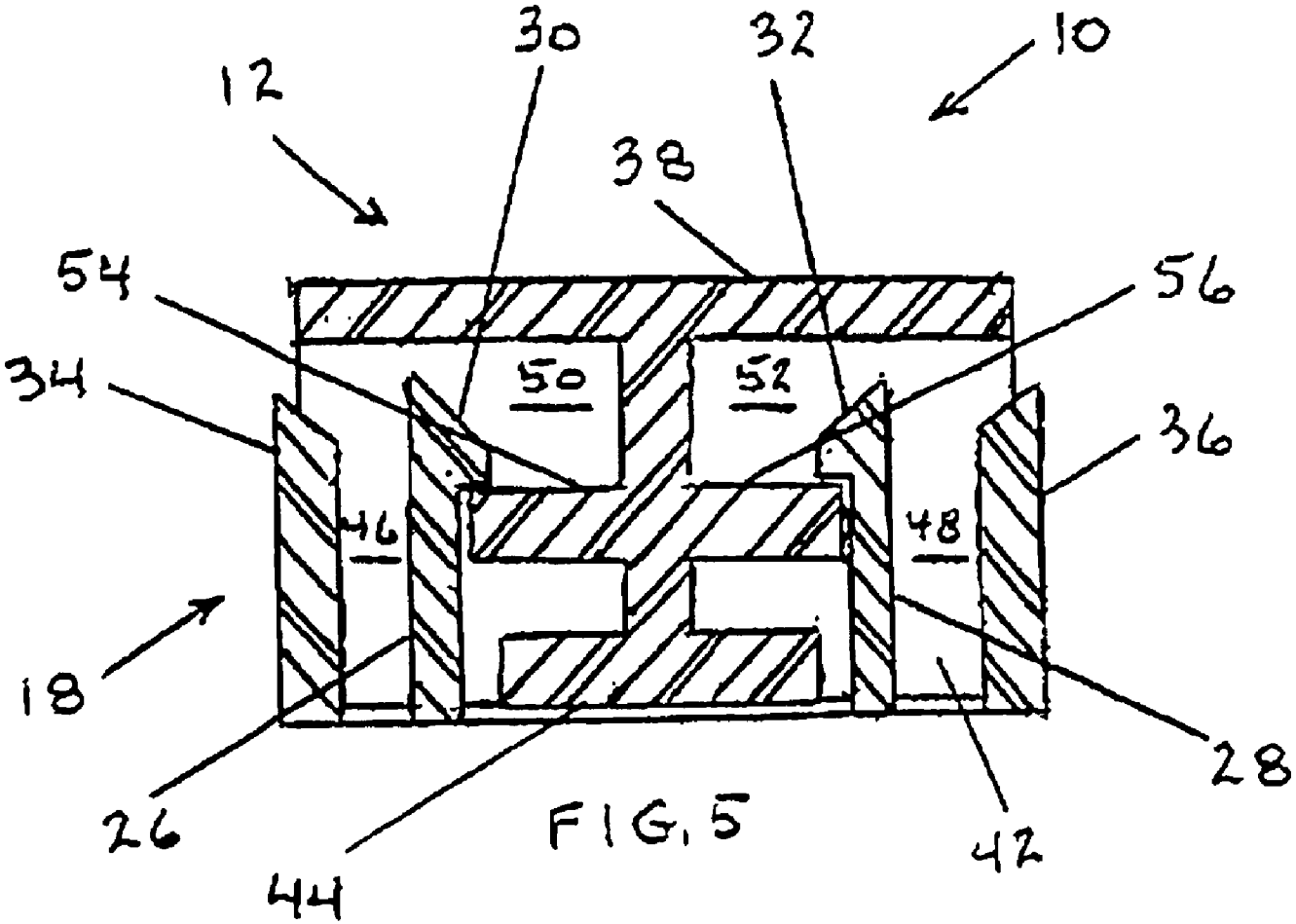
FIG. 5 is a partial view of the hanger of FIG. 2 in assembly with the size marker of FIGS. 3 and 4, shown in central section.

Referring to FIG. 5, it shows, in central partial section, the assembly of hanger 10 and size marker 12. As is seen, size marker retaining members 26 and 28 of hanger 10 are resident in passages 46 and 48 of size marker 12 and ceiling 38 thereof nests within sidewalls 22 and 24 of hanger 10, forming a planar surface with hanger portions 10*a* and 10*b* (FIGS. 1 and 1A). This results from the above-noted foreshortening of size marker retaining members 26 and 28 relative to hanger sidewalls 22 and 24. Retention structures 30 and 32 of size marker 12 are disposed in recesses 50 and 52 thereof and overlie hook latching ledges 54 and 56.

In reaching the assembly of FIG. 5, size marker 12 is forced into size marker receiving portion 18 of hanger 10. In the initial course of the insertion, floor portion 44 of size marker 10 passes freely interiorly of size marker retaining members 26 and 28. As the insertion continues, ledges 54 and 56 confront the tapered upper surfaces of retaining structures 30 and 32 of size marker retaining members 26 and 28 and deflect them outwardly. Next, as ledges 54 and 56 pass by retaining structures 30 and 32, the retaining structures enter recesses 50 and 52, thus latching size marker 12 to hanger 10.

Various changes may be introduced in the disclosed preferred embodiment without departing from the invention. By way of example, another embodiment of the invention may include but a single retaining structure of the hanger and a single latching ledge in contrast to the plural arrangement of retaining structures and latching recess of the disclosed preferred embodiment. Accordingly, it is to be appreciated that the true spirit and scope of the invention is set forth in the following claims.

What is claimed is:

1. A garment hanger comprising:

a support rod engaging portion;

a garment supporting portion;

a size marker receiving portion having a pair of spaced apart side walls, a floor spanning between said side walls and a pair of spaced apart resilient size marker retaining members extending from said floor for resilient movement toward and away from said adjacent side walls having mutually inwardly facing hooks at the distal ends thereof; and a size marker having a rigid body including a ceiling and opposed front and back walls extending from said ceiling defining open side passages and hook catching ledges supported between said front and back walls for engagement with said hook retaining members upon insertable attachment of said size marker to said size marker receiving portion;

said insertable attachment causing outward resilient deflection of said retaining member towards said adjacent side walls and locking engagement therewith upon resilient return of said retaining walls away from said adjacent side walls.

2. A garment hanger of claim 1 wherein said side walls extend from said floor a distance greater than the distance said size marker retaining members extend from said floor.

3. A garment hanger of claim 2 wherein said side walls enclose said open side passages of said size marker upon insertable attachment thereof.

4. A garment hanger of claim 1 wherein said size marker further includes a floor portion extending between said side walls, said floor portion being seatable on said floor of said size marker receiving portion upon said insertable attachment thereto.

5. A garment hanger of claim 2 wherein said side walls include guide ribs thereon.

* * * * *